US009511920B2

(12) United States Patent
Baker et al.

(10) Patent No.: US 9,511,920 B2
(45) Date of Patent: Dec. 6, 2016

(54) EDGE PROTECTOR

(71) Applicant: T & M Design, LLC, Saginaw, MI (US)

(72) Inventors: Marcus Baker, Saginaw, MI (US); Todd Fleury, Cambridge, CA (US)

(73) Assignee: T & M Design, LLC, Saginaw, MI (US)

( * ) Notice: Subject to any disclaimer, the term of this patent is extended or adjusted under 35 U.S.C. 154(b) by 43 days.

(21) Appl. No.: 13/937,791

(22) Filed: Jul. 9, 2013

(65) Prior Publication Data

US 2015/0014334 A1 Jan. 15, 2015

(51) Int. Cl.
*B65D 81/05* (2006.01)

(52) U.S. Cl.
CPC ..... *B65D 81/054* (2013.01)

(58) Field of Classification Search
CPC ..... B65D 81/053; B65D 81/054; B65D 2581/053; B65D 2581/055; B65D 2581/056; Y10T 428/1303
USPC ..... 206/586, 453; 428/174
See application file for complete search history.

(56) References Cited

U.S. PATENT DOCUMENTS

| | | | | |
|---|---|---|---|---|
| 2,670,122 | A | | 2/1954 | Davidson et al. |
| 3,613,985 | A | | 10/1971 | Goodsite |
| 4,292,901 | A | | 10/1981 | Cox |
| 4,742,916 | A | | 5/1988 | Galea |
| 4,877,673 | A | | 10/1989 | Eckel et al. |
| 5,048,689 | A | | 9/1991 | McFarland |
| 5,149,575 | A | * | 9/1992 | Soifer ..... 428/188 |
| 5,267,651 | A | | 12/1993 | Hughes |
| 5,385,236 | A | | 1/1995 | Cowan et al. |
| 5,593,039 | A | | 1/1997 | Ortlieb |
| 5,947,290 | A | | 9/1999 | Loeschen |
| 6,059,104 | A | | 5/2000 | Widman |
| 6,186,329 | B1 | | 2/2001 | Qiu |
| 6,234,314 | B1 | | 5/2001 | Qiu et al. |
| 6,247,596 | B1 | | 6/2001 | Muyskens |
| 6,286,683 | B1 | | 9/2001 | Hunt et al. |
| 6,457,636 | B1 | | 10/2002 | Van De Ven et al. |
| 6,513,662 | B1 | | 2/2003 | Stebelton |
| 6,520,336 | B2 | | 2/2003 | Baechle |
| 6,527,119 | B1 | | 3/2003 | Markert et al. |
| 6,561,357 | B2 | | 5/2003 | Renck |
| 6,595,367 | B2 | | 7/2003 | Baechle |
| 6,915,603 | B2 | | 7/2005 | Hunt |
| 7,014,046 | B2 | | 3/2006 | Niu et al. |

(Continued)

OTHER PUBLICATIONS align. 2015. TheFreeDictionary.com. Retrieved Dec. 4, 2015, from http://www.thefreedictionary.com/align.*

*Primary Examiner* — Laura Auer
(74) *Attorney, Agent, or Firm* — Warner Norcross & Judd LLP

(57) ABSTRACT

An edge protector for disposition along an angled edge of an article includes a pair of interior walls; the walls being integrally joined in angular relation to one another at an interior edge when the angle edge protector is in an in-use configuration disposed along the angled edge of the article; a first exterior wall connected to an end of one of the pair of interior walls; and, a first arcuate wall having a first end integrally joined with the first exterior wall, the first arcuate wall having a curvature such that a second end of the first arcuate wall is proximate the interior edge when the angle edge protector is in the in-use configuration. Preferably, there are two arcuate portions, and the edge protector is symmetrical.

8 Claims, 4 Drawing Sheets

(56) References Cited

U.S. PATENT DOCUMENTS

| | | | | |
|---|---|---|---|---|
| 7,028,964 | B2 | 4/2006 | Baechle | |
| 7,048,118 | B2 | 5/2006 | Baechle | |
| 7,048,119 | B2 | 5/2006 | Baechle | |
| 7,111,734 | B2 | 9/2006 | Robinson, Jr. | |
| 7,128,214 | B2 | 10/2006 | Qiu et al. | |
| 7,216,765 | B2 | 5/2007 | Markert et al. | |
| 7,299,924 | B2 | 11/2007 | Robinson, Jr. | |
| 7,625,616 | B2 | 12/2009 | Van de Camp | |
| 7,841,469 | B2 | 11/2010 | Muyskens | |
| 8,079,476 | B2 | 12/2011 | Simms et al. | |
| 8,297,492 | B2 | 10/2012 | Muyskens | |
| 2002/0189969 | A1* | 12/2002 | Renck | 206/586 |
| 2003/0052037 | A1* | 3/2003 | Baechle | 206/586 |
| 2004/0232145 | A1 | 11/2004 | Antal, Sr. et al. | |
| 2008/0237419 | A1 | 10/2008 | Baechle et al. | |
| 2008/0256881 | A1 | 10/2008 | Lowry et al. | |
| 2008/0256897 | A1 | 10/2008 | Lowry et al. | |
| 2011/0278198 | A1 | 11/2011 | Hazell | |

* cited by examiner

EDGE PROTECTOR

FIELD OF THE INVENTION

The present invention relates generally to the packaging of articles in shipping containers or otherwise packing for transport, such as on pallets, and more particularly to an angle edge protector for use in such shipping or transport.

BACKGROUND OF THE INVENTION

Various ways of protecting articles during storage or shipping are known in the art. Articles such as furniture, for example are often shipped with various protective barriers or soft materials covering portions of the furniture. Sometimes, these protective barriers and materials occupy a lot of space or can increase the cost of transporting these materials significantly. Furthermore, while protection from movement of the article within a shipping container is protective in and of itself, some parts of articles being shipped are more susceptible to damage. For example, the corners or edges of an article are more prone to damage from impact rather than from pressure.

Various edge protectors are known in the prior art, ranging from angled cardboard or molded pulp to custom produced foam protective products. Often, the more impact resistant an edge protector is, the more materials, complexity of manufacture, or use of different materials are required. This leads to an increase in packaging costs, often times a larger footprint required for packaging or transport, and an overall environmental impact that could be improved upon. More basic edge protectors that are used often provide insufficient protection against impact. Other prior art solutions lack axial strength, and while able to handle loads, the edge protectors themselves can be damaged when subject to axial loads such that the protection they later provide is tainted by permanent deformation that has been caused due to such axial loads.

Finally, it would also be beneficial for an edge protector to provide stack strength such that the edge protector can be used with palletized products, in addition to being used within a transport container.

SUMMARY OF THE INVENTION

In accordance with one embodiment of the invention, there is provided an edge protector for disposition along an angled edge of an article including a pair of interior walls; the walls being integrally joined in angular relation to one another at an interior edge when the angle edge protector is in an in-use configuration disposed along the angled edge of the article; a first exterior wall connected to an end of one of the pair of interior walls; and, a first arcuate wall having a first end integrally joined with the first exterior wall, the first arcuate wall having a curvature such that a second end of the first arcuate wall is proximate the interior edge when the angle edge protector is in the in-use configuration.

Various optional aspects of the invention will now be identified.

According to an aspect of the invention, the edge protector further includes a second exterior wall connected to an end of another of the pair of interior walls.

According to another aspect of the invention, the edge protector further includes a second arcuate wall having a first end integrally joined with the second exterior wall, the second arcuate wall having a curvature such that a second end of the second arcuate wall is proximate the interior edge when the angle edge protector is in the in-use configuration.

According to another aspect of the invention, the edge protector is positionable in a storage configuration; the pair of interior walls being integral and planar with one another in the storage configuration.

According to another aspect of the invention, the first exterior wall is planar with the pair of interior walls in the storage configuration; and further comprising a divot forming a joining portion between the first exterior wall and the end of the one of the pair of interior walls.

According to another aspect of the invention, the edge protector further includes a second exterior wall connected to an end of another of the pair of interior walls; wherein the second exterior wall is planar with the pair of interior walls in the storage configuration; and further comprising a hinge means between the second exterior wall and the end of another of the pair of interior walls.

According to another aspect of the invention, the angular relation is at a right angle.

According to another aspect of the invention, the edge protector comprises a material selected from the group consisting of paper, molded pulp, plastic, phenolic and metal.

According to another aspect of the invention, the interior edge comprises an arcuate portion having a radius larger than a radius of the angled edge of the article.

BRIEF DESCRIPTION OF THE DRAWINGS

An embodiment will now be described, by way of example only, with reference to the attached Figures, wherein.

DETAILED DESCRIPTION OF THE PREFERRED EMBODIMENT

The edge protector as herein described may be used in one or more of the following applications, by way of example only, with containerized articles during storage or shipping, for corner or edge protection of palletized products, to provide internal support for containerized articles when subjected to compression forces and to provide internal support for containerized articles when subjected to impact forces. It will be understood by one skilled in the art that these uses are provided by way of example only and particular applications of the edge protector will dictate the type of protection being provided for an article employing the edge protector according to the invention.

Figure 1:
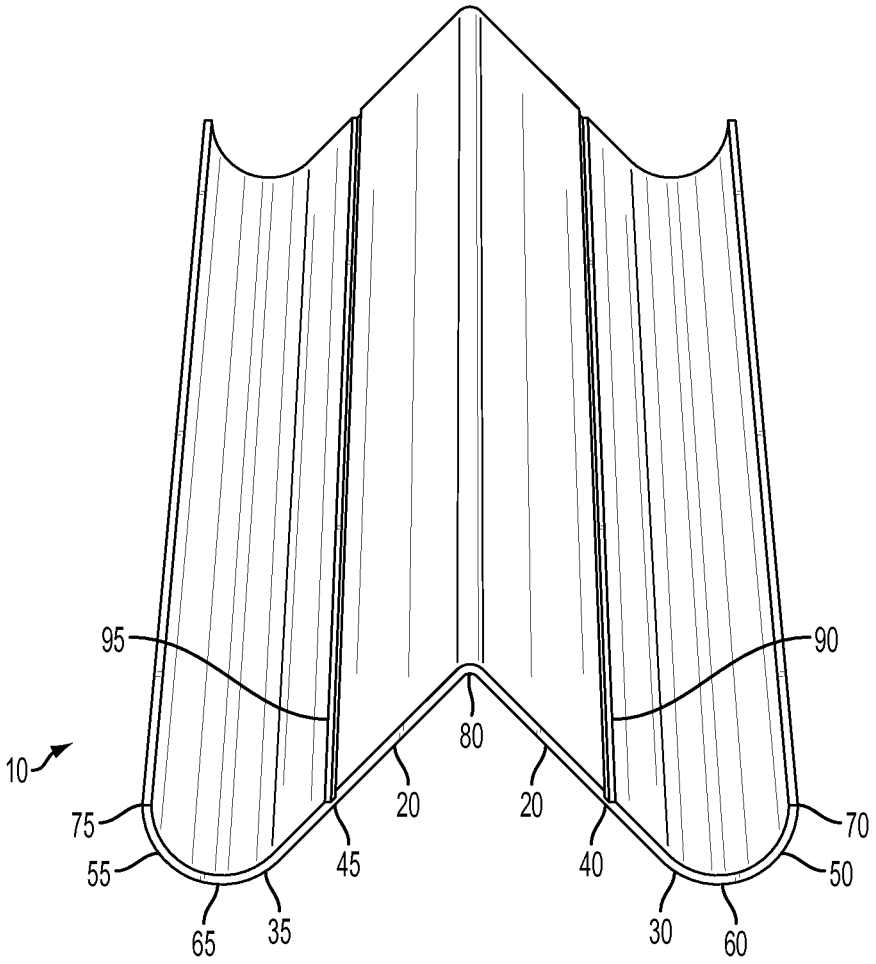
FIG. 1 is a top perspective view of an edge protector according to one embodiment of the invention prior to an in-use configuration.
Figure 2:
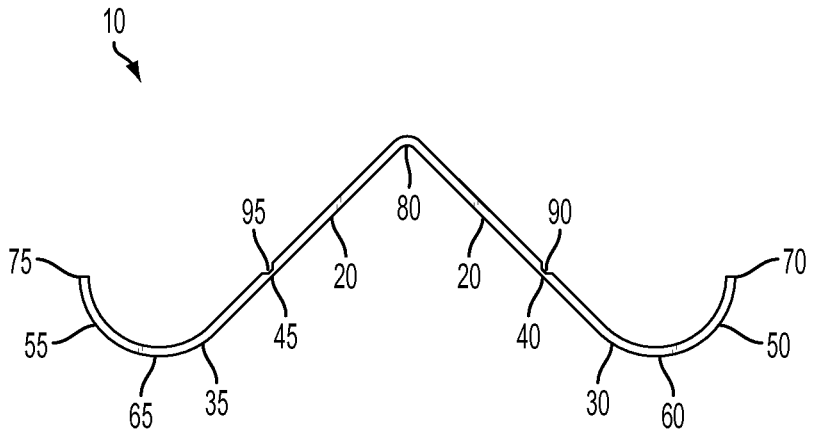
FIG. 2 is a front profile view of the edge protector of FIG. 1.
Figure 3:
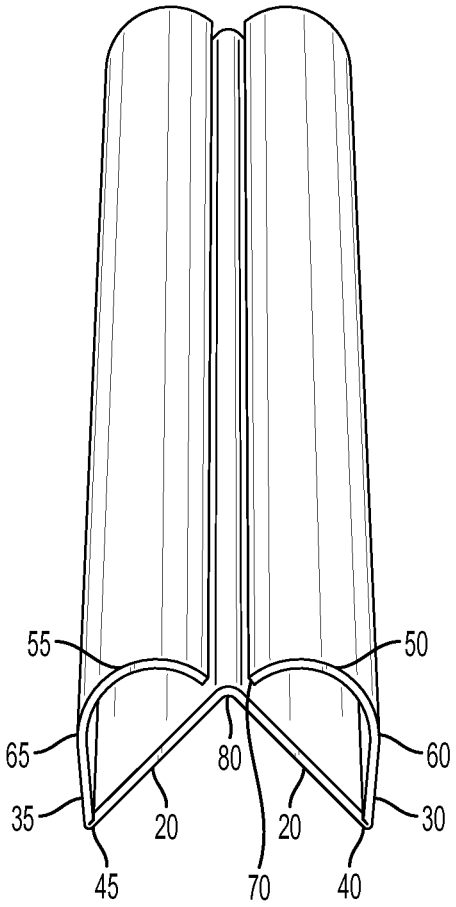
FIG. 3 is a top perspective view of the edge protector of FIG. 1 in an in-use configuration.
Figure 4:
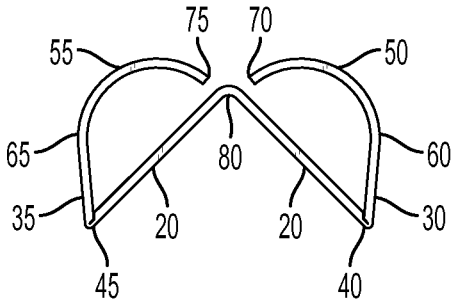
FIG. 4 is a front profile view of the edge protector of FIG. 3.

The edge protector according to the preferred embodiments includes an in-use configuration as best illustrated in FIG. 3 and FIG. 4 and a stored configuration optimized for transporting or storing the edge protectors themselves. FIG. 1 and FIG. 2 illustrate the edge protector in an intermediary configuration between a flat, stored configuration and the in-use configuration of FIG. 3 and FIG. 4.

In this regard, and referring now to the drawings, there is shown an edge protector 10 for disposition along an angled edge of an article (not shown). The article may consist of any article being stored or shipped that may be prone to damage along an edge thereof when being transported or stacked. The edge protector 10 includes a pair of interior walls 20 being integrally joined in angular relation to one another at an interior edge 80 when the angle edge protector is in an in-use configuration and disposed along the angled edge of the article.

A first exterior wall 30 is connected to an end 40 of one of the pair of interior walls 20. A first arcuate wall 50 having a first end 60 integrally joined with said first exterior wall 30, and a second end 70 positioned proximate the interior edge 80 when the edge protector 10 is in the in-use configuration is provided. The first arcuate wall 50 has a curvature that is dimensioned to enable the second end 70 to be positioned proximate the interior edge 30. The arcuate wall 50 provides stability and enhanced impact protection to the edge protector, and particularly along one side proximate the edge of the article being protected.

Preferably, a second arcuate wall 55 is also provided such that surfaces along both sides of the edge can be protected. To this end, a second exterior wall 35 is also provided connected to an end 45 of the other of the pair of interior walls 20. The second arcuate wall having a first end 65 integrally joined with the second exterior wall 35, and a second end 75 positioned proximate the interior edge 85 when the edge protector 10 is in the in-use configuration. The second arcuate wall 55 has a curvature that is dimensioned to enable the second end 75 to be positioned proximate the interior edge 80.

The interior edge 80 may itself include an interior arcuate portion depending on the shape of the edge intended to be protected. Preferably, the radius of the interior arcuate portion is marginally larger than a radius of the edge being protected.

When in the storage configuration of FIGS. 1 and 2, the edge protector is positionable such that the pair of interior walls 20 are integral and planar with one another. This permits the edge protector to occupy a reduced area when stored or transported itself. In addition, the first exterior wall 30 is planar with the pair of interior walls 20 in the storage configuration. The edge protector 10 then further includes a hinge means 90 forming a joining hinge portion between the first exterior wall 30 and the end 40 of one of the pair of interior walls 20. The hinge 90 may be strengthened along its edges such that it is not a point of weakness in the overall structure of the edge protector 10, but provides for a position along which the edge protector 10 may be readily folded into its in-use configuration. Hinge means 90 is preferably a divot, but may also be a crease, removal of interior material to provide a thinner section or other feature that permits the hinge motion as illustrated. The edge protector 10 may include a hinge means 95, similar to hinge 90, that forms a joining hinge portion between the second exterior wall 35 and end 45 of the other of the pair of interior walls 20.

The edge protector according to the invention is preferably symmetrical, but non-symmetry is also contemplated. For example, where the article being protected has a shortened side, the arcuate portion along the shortened side can be made small than the other arcuate portion.

The arcuate portions mentioned above provide for sufficient support for distributed loads being applied to the article being protected. In addition, articles with the edge protector thereon in the in-use configuration may be readily stacked along respective arcuate portions. The arcuate portions themselves have a radius that results in the arcuate portions extending to encapsulate approximately the entirety of the edge being protected and a predetermined adjacent portion. The invention as herein described is scalable to protect various sizes and dimensions of articles. In especially preferred embodiments, the length of the edge protector is from about 1 inch to 53 feet. The internal walls having a linear length of between about 1 inch to 12 inches, and the thickness of the edge protector is from about 0.03 inches to 0.5 inches. These dimensions are exemplary only and described to illustrate the scalability of the edge protector according to the invention.

The edge protector of the invention may be manufactured from a number of materials, including but not limited to paper, molded pulp, corrugated board, plastics, phenolic and metal. The edge protector may be coated to prevent moisture absorption, marring and/or to provide for scratch resistance.

While the illustrated embodiments appear to show the angle of two surfaces adjacent the edge being protected being a right angle, it is contemplated that other angles of edges may also be protected, and it will now be evident to a person skilled in the art that a variety of angles may be protected using the teachings of the invention.

In contrast to prior art edge protectors, the invention as herein described provides for increased strength, using less raw materials. Impact protection is also improved upon by virtue of the resiliency provided in the profile shape of the edge protector. In particular, the arcuate portions are able to absorb impact that in many prior art protectors would be absorbed solely by the material itself. In addition, the axial strength provided by the frame structure of the internal and external wall portions results in a stronger edge protector that is likely to itself be damaged when in use. In other embodiments, the arcuate portions may for angled portions or "V" shaped portions.

The above-described embodiments are intended to be examples of the present invention and alterations and modifications may be effected thereto, by those of skill in the art, without departing from the scope of the invention, which is defined solely by the claims appended hereto.

What is claimed is:

1. An edge protector for disposition along an angled edge of an article comprising:

a pair of interior walls; said walls being integrally joined in angular relation to one another at an interior edge when the angle edge protector is in an in-use configuration disposed along the angled edge of the article;

a first exterior arcuate wall connected to an end of one of said pair of interior walls, said first exterior arcuate wall having a curvature that converges with said interior edge when the angle edge protector is in said in-use configuration;

a second exterior arcuate wall connected to an end of the other of said pair of interior walls, said second exterior arcuate wall having a curvature that converges with said interior edge when the angle edge protector is in said in-use configuration;

wherein the angle edge protector is positionable in a storage configuration; said pair of interior walls being integral and planar with one another in said storage configuration;

and wherein said first exterior arcuate wall is planar with said pair of interior walls in said storage configuration; and further comprising a divot forming a portion between said first arcuate exterior wall and said end of said one of said pair of interior walls.

2. An edge protector according to claim 1, further comprising a first hinge forming a joining portion between said first arcuate exterior wall and said end of one of said pair of interior walls; and a hinge forming a joining portion between said second arcuate exterior wall and said end of the other of said pair of interior walls.

3. An angle edge protector according to claim 1, wherein said angular relation is at a right angle.

4. An edge protector according to claim 1, wherein said edge protector comprises paper liner board.

5. An edge protector according to claim 1, wherein said edge protector comprises a material selected from the group consisting of paper, molded pulp, plastic, phenolic, and metal.

6. An edge protector for disposition along an angled edge of an article comprising:

a first and a second interior walls coupled to each other by an integrally joined edge in angular relation to one another when the edge protector is in an in-use configuration disposed along the angled edge of the article;

a first exterior wall coupled by a first hinged edge to an exterior edge of the first interior wall; the length along the first exterior wall being longer than the length of the first interior wall; and the first exterior wall being shaped to converge with the integrally joined edge.

7. The edge protector according to claim 6 further comprising:

a second exterior wall coupled by a second hinged edge to an exterior edge of the second interior walls; the length along the second exterior wall being longer than the length of the second interior wall; and the second exterior wall being shaped to coverage with the integerally joined edge.

8. The edge protector according to claim 6, wherein at least a portion of the first interior wall directly adjacent the first hinged edge contacts a portion of the article when the edge protector is disposed along an angled edge of the article.

* * * * *